US009734704B2

(12) United States Patent
Lee

(10) Patent No.: US 9,734,704 B2
(45) Date of Patent: Aug. 15, 2017

(54) WIRELESS GAUNTLET FOR ELECTRONIC CONTROL

(71) Applicant: Dominick S. Lee, San Lorenzo, CA (US)

(72) Inventor: Dominick S. Lee, San Lorenzo, CA (US)

( * ) Notice: Subject to any disclaimer, the term of this patent is extended or adjusted under 35 U.S.C. 154(b) by 99 days.

(21) Appl. No.: 14/825,103

(22) Filed: Aug. 12, 2015

(65) Prior Publication Data

US 2016/0049073 A1 Feb. 18, 2016

Related U.S. Application Data

(60) Provisional application No. 62/036,236, filed on Aug. 12, 2014.

(51) Int. Cl.
*G08C 17/02* (2006.01)
*G08C 23/04* (2006.01)

(52) U.S. Cl.
CPC ..... *G08C 17/02* (2013.01); *G08C 23/04* (2013.01)

(58) Field of Classification Search
CPC ..... G08C 17/02; G08C 23/04; G08C 17/00; G08C 19/28; G08C 2201/20; G08C 23/02; G08C 2201/21; G08C 2201/32; G08C 2201/92
USPC ..... 340/12.5
See application file for complete search history.

(56) References Cited

U.S. PATENT DOCUMENTS

| | | | | |
|---|---|---|---|---|
| 7,821,407 | B2 * | 10/2010 | Shears | A61B 5/1127 340/573.1 |
| 8,684,839 | B2 * | 4/2014 | Mattice | G06F 3/013 463/29 |
| 9,410,979 | B2 * | 8/2016 | Yuen | G01P 7/00 |
| 9,417,693 | B2 * | 8/2016 | Seth | G06F 3/014 |
| 9,536,449 | B2 * | 1/2017 | Connor | G09B 19/0092 |
| 2014/0267024 | A1 * | 9/2014 | Keller | G06F 3/017 345/156 |

* cited by examiner

*Primary Examiner* — Mark Blouin

(57) ABSTRACT

A wireless control system and method that can replace the traditional usage of a keyboard, mouse, handheld joystick, and remote to control apparatus such as mobile devices, computers, robotics, and appliances is disclosed. In various embodiments, the invention comprises two main electrical devices and one interchangeable attachment. The first main device comprises a gauntlet that can be strapped on an arm. This device, when active, can be used to transmit dynamic wireless signals which report the acceleration, orientation, and direction of one's wrist and calculate relative position of the palm. The second main device comprises a wireless programmable base receiver for receiving and processing the aforementioned wireless signals from the wireless gauntlet. The wireless programmable base receiver can be attached to an interchangeable attachment to trigger an electrical device such as a robot, electrical appliance, or computer that corresponds to the signals received from the gauntlet that subsequently become recognized as gestures. Accordingly, the base receiver can be used to control various applications. Several base receivers can be combined to form a control-zone, which gives a user the ability to control a set of electrical devices. Similarly, multiple users wearing a gauntlet may control the same electrical device.

22 Claims, 4 Drawing Sheets

WIRELESS GAUNTLET FOR ELECTRONIC CONTROL

FIELD

This invention relates to the field of wireless control of one or more electronic apparatus, such as mobile devices, computers, robotics, and appliances. More specifically, the invention relates to wireless control systems and methods that can replace the traditional usage of a keyboard, mouse, handheld joystick, and remote to control apparatus such as mobile devices, computers, robotics, and appliances.

BACKGROUND

Electronic Controllers

There are known peripheral devices that can wirelessly control computers, robotics, electrical appliances, and/or computers. Most of these devices comprise electronic controllers such as a keyboard, mouse, handheld joystick, remote, or switch. Electronic controllers have enhanced the convenience of human interaction with electronic apparatus at a distance. Most of these electronic controllers are handheld devices which are intended to control one device with correlating capability. For example, a remote for a car alarm may only control the car it was designed for. Furthermore, the remote for a car alarm may not be used for controlling a television, computer, etc. due to differences in compatibility of the signal transmitted.

The convenience brought by electronic controllers is very beneficial. However, electronic controllers can be burdensome when more than one device is carried at a time. This problem is addressed by making a device which can act as an electronic controller for a plurality of electrical apparatus.

Wearable Electronic Devices

There have been many instances of wearable devices such as devices worn on the head, arm, wrist, leg, ear, finger, and other body parts that perform functions such as fitness tracking, phone call notifications, SMS notifications, using short-distance wireless technologies such as Bluetooth to communicate with a mobile device application for record keeping and processing. These devices were often dependent on connection to a smartphone device to offer full functionality. In recent years, wearable technology has become more common. For example, several companies recently developed standalone wrist-worn products also known as smartwatches, media players, and fitness bracelets, which can operate independently without the need of a smartphone.

Even with the existence of wrist-worn wearable devices, one is still required to interact with the device with the hand opposite to which the device is being worn. Attempts have been made to use myoelectrical signals from the muscles of the hand and control devices. An electromyography (EMG) device was developed which utilizes the myoelectric signals from one's hand. (See U.S. Pat. No. 6,244,873 B1, incorporated herein by reference.) Although EMG gesture control has been shown as a precise way in terms of gesture control, it often has flaws in recognition and may bring undesired results, for example, when one's natural physical movement matches a gesture detected by the EMG system. For example, one may pick up a glass of water but accidentally trigger an EMG signal which subsequently becomes recognized as a gesture. (See Peters, T. (2014). An Assessment of Single-Channel EMG Sensing for Gestural Input; incorporated herein by reference.) The present invention avoids this issue by providing a solution for precise gesture detection without the flaws in EMG technology.

It is an object of the present invention to provide wearable devices with the ability to control more than one device at a time, having long-range capabilities, and the ability to calculate palm orientation in correlation with the force exerted by palm or wrist of the same hand for gesture recognition.

Proximity Devices

IR (infrared)-proximity sensors can sense the presence of a solid object, its distance from a reference, or both. Current applications include speed detection, sensing of the hand in automatic faucets, automatic counting or detection of objects on conveyer belts, and paper-edge detection in printers. The latest-generation smartphones, for example, can turn off an LCD touchscreen to prevent the accidental activation of soft buttons when the screen touches one's ear.

To sense an object, a proximity sensor transmits IR pulses toward the object and then "listens" to detect any pulses that reflect back. An IR LED transmits the IR signals, and an IR photodetector detects the reflected signal. The strength of this reflected signal is inversely proportional to the distance of the object from the IR transceiver. Because the reflected IR signal is stronger when the object is close, the output of the photodiode can be calibrated to determine the trigger distance of an object. The trigger distance indicates the threshold for making a decision on whether an object is present.

While infrared sensing is advantageous to human interaction with devices, the current implementation of IR sensing faces issues in accurately detecting the distance of an object when another foreign object physically reflects the signal. Another issue arises when a proximity device is placed under a bright lamp or direct sunlight. Since ambient light generally comprises a certain degree of infrared wavelengths, undesired optical interference can occur that can inhibit the accuracy of detection for gesture control. Attempts have been made to use infrared sensing to recognize gestures made by hand. For example, a group implemented a wrist-worn gesture recognition device with basic IR emitters and receivers but faced issues of environment conditions such as sunlight and also required the use of the hand opposite to which the device was worn. (See Kim, J., He, J., Lyons, K., & Starner, T. (2007, October). The gesture watch: A wireless contact-free gesture based wrist interface. In Wearable Computers, 2007 11th IEEE International Symposium on (pp. 15-22). IEEE; incorporated herein by reference.)

It is an object of the present invention to provide proximity sensing devices having the capability of gesture recognition by way of wrist and palm motions of one's hand. It is a further object of the present invention to overcome the issue of interference via a modulated IR sensor array containing two or more sensors wrapped around one's wrist. It will be appreciated by those skilled in the art that such a modulated IR sensor array can provide three-dimensional data and even detect gestures which are unobtainable by standard IR proximity sensors.

Home Automation Devices

Home automation (HA) has emerged incrementally throughout the past decades. The purpose of home automation is to enhance one's daily life through devices that can be controlled with more than just local physical interaction with a device. Home automation introduces a vision for homes and offices having remote controlled appliances and appliances that can be controlled with seamless interaction. For example, a simple home automation device could be a remote controlled AC outlet, which comprises a remote and a receiver in the form of a wall outlet. With this device, a user is able to control an appliance or electrical device beyond physical reach. As the home automation technology continued to improve, home networking and appliance control grew into a field known as IoT (Internet of Things). The field of IoT introduces devices with capabilities to perform two main tasks—connect to a predefined webserver, and to control one or more appliances or electronic devices. Throughout the technological advances, the most prominent method of home automation is with the current technology of IoT.

While it is beneficial for internet-connected mobile phones and computers to control IoT enabled appliances and electronics, an issue arises when control of such appliances is limited to the manipulation of mobile phones and computers. As wearable electronic devices were slowly introduced into the field of IoT, their applications were directed towards the use of collecting fitness data and/or displaying smartphone notifications and there have been significant improvements in these regards, but such devices have not been developed for direct control over home automation.

It is an object of the present invention to provide a system comprising a wearable device for the wrist employing modulated IR sensor arrays that can control IoT enabled devices.

SUMMARY OF VARIOUS EMBODIMENTS

An exemplary and non-limiting summary of various embodiments is set forth next.

According to various embodiments, the present teachings provide wireless control systems and methods that can replace the traditional usage of a keyboard, mouse, handheld joystick, and remote to control apparatus such as mobile devices, computers, robotics, and appliances. Various embodiments of the invention comprise two main electrical devices and one interchangeable attachment that provide for various technical capabilities of the invention. The first device comprises a gauntlet that can be strapped on the arm, e.g., at the wrist. This device, when active, can be used to transmit dynamic wireless signals which report the acceleration, orientation, and direction of one's wrist and calculate relative position of the palm. In some embodiments where extra control is desired, a pressure sensor can be strapped to one's wrist or palm to provide for additional control. The second device comprises a wireless programmable base receiver for receiving and processing the aforementioned wireless signals from the wireless gauntlet. The wireless programmable base receiver can be attached to an interchangeable attachment to trigger an electrical device such as a robot, electrical appliance, or computer that corresponds to the signals received from the gauntlet that subsequently become recognized as gestures. Accordingly, various embodiments of the present invention provide the capability to control various applications with a seamless gesture without the need for extensive hardware.

According to various aspects of the present teachings, a wireless control system is provided. In various embodiments, the wireless control system can comprise: (i) a wearable device adapted to be worn on the forearm of a user and comprising a wireless transmitter for wirelessly transmitting signals comprising sensory data; (ii) a receiver base comprising a wireless receiver and a processor, for receiving wirelessly transmitted signals comprising sensory data and processing the signals; and (iii) an interchangeable circuit attached adjacent to, and in electrical communication with, the receiver base, adapted to conduct electrical interaction with a target apparatus In some embodiments, the target apparatus is selected from the group consisting of a robotic instrument, an electrical appliance, a mobile device, and a computer.

In a variety of embodiments, the target apparatus comprises a lamp, an entertainment system, an appliance, a robotic apparatus, an infrared device, a thermostat, a computer, a security system, a garage door, an electric door lock, a laundry machine, a camera, a video camera, or a mobile device.

In some embodiments, the wireless control system further comprises a magnetic electrical circuit connector on the receiving apparatus and a mating magnetic electrical circuit connector on the gauntlet.

In various embodiments, the receiver base controls the interchangeable circuit using sensory data received from the wireless gauntlet.

In a variety of embodiments, the interchangeable circuit comprises electrical circuitry configured with electrical correspondence to the receiving apparatus.

In various embodiments, the wireless control system further comprises strong magnetic elements of opposing polarity positioned on the interchangeable circuit and the receiving apparatus for attaching the interchangeable circuit to the receiving apparatus.

According to a variety of embodiments, the interchangeable circuit is of relative size and shape to the receiving apparatus, e.g., the interchangeable circuit can be of approximately the same or similar size and shape as the receiving apparatus, or somewhat smaller.

In various embodiments, the wireless control system further comprises a rechargeable battery for powering the receiving apparatus. In some embodiments, a second rechargeable battery can be provided for powering the wireless gauntlet.

In accordance with various embodiments, the receiving apparatus can comprise programmable circuitry for configuring identification of the receiving apparatus and the target apparatus.

Further aspects of the present teachings relate to a wireless device for the control of a target electrical apparatus, such as a robotic instrument, an electrical appliance, a mobile device or a computer. According to various embodiments, such a wireless device can comprise: (i) a wireless gauntlet comprising a casing; (ii) a band attached to the casing in order that the gauntlet can be worn on the forearm (e.g., wrist) of a user; (iii) one or more inertial measurement sensors within the casing; (iv) one or more modulated infrared sensor arrays supported by the casing and the band; and (v) a processor within the casing and disposed for receiving inputs from the inertial measurement sensors and the modulated sensor arrays. The processor can be programmed to calculate the orientation of a user's palm and fingers using inputs from the inertial measurement sensors and the modulated sensor arrays, with the user's palm and fingers being free of any orientation measurement apparatus. In some embodiments, the device can further comprise a long-range wireless transceiver for transmitting signals from said processor.

According to various embodiments, the device further comprises software code executable by the microprocessor of the wireless gauntlet for calculating the palm position in which a wrist is bent based on at least two of the modulated infrared sensor arrays.

In a variety of embodiments, the device further comprises a force sensor in communication with the microcontroller of the gauntlet and a second band attached to the gauntlet for supporting the force sensor, wherein the second band is removably attachable to a user's hand.

In some embodiments, the wireless gauntlet comprises an accelerometer, a gyroscope, and/or a compass, each disposed for communication with the processor.

Still further aspects of the present teachings relate to a system for remote control of electrical apparatus, wherein the system includes a wireless gauntlet adapted to be worn on a user's wrist and configured to transmit wireless signals comprising sensory data containing information about the user's wrist orientation, acceleration, and direction. According to various embodiments, the system can comprise: (i) a base station; (ii) a wireless receiver in the base station for receiving the wireless signals; (iii) a processor within the base station for processing signals received; wherein the user's forearm gesture can be determined with the information received on wrist orientation, acceleration, and direction; and further wherein the position of the user's palm relative to the user's wrist can be calculated; and further comprising (iv) an electrical interface for electrical communication with an interchangeable accessory circuit to interact with a robotic instrument, an electrical appliance, mobile device or a computer in a manner determined by the user's gesture and palm position.

In various embodiments, the system further comprises a control-zone comprised of a designated plurality of base stations disposed in a defined area, all within the transmission range of a long-range wireless gauntlet.

In some embodiments, each base station of the designated plurality of base stations comprises programmable circuitry for associating every base station with the other base stations of the control zone.

In a variety of embodiments, the designated plurality of base stations in the control-zone are configured to be controllable by one or more selected wireless gauntlets.

In accordance with various embodiments, a predefined gesture, such as an unnatural gesture, by the user causes a wireless gauntlet worn by the user to transmit signals for switching its interaction from the base station to a second base station in the control-zone, or switching from the control zone to a second control zone.

According to some embodiments, the base station can communicate with a plurality of wireless gauntlets in the control zone.

In a variety of embodiments, a plurality of wireless gauntlets can simultaneously control a selected base station within the control zone.

In various embodiments, a base station in the control zone is configured to extend the wireless range of another base station in the control zone.

Yet still a further aspect of the present teachings relates to a wireless system for remotely controlling a selected target apparatus configured for remote operation. In a variety of embodiments, such a wireless system can comprising: (i) a wireless transmitter comprising one or more sensors; (ii) a first band configured to hold the transmitter, which band can be removably attached to a user's arm; (iii) a wireless receiving apparatus distal from the transmitter, which comprises a microcontroller and can receive and process wireless signals sent by the transmitter; and (iv) an interchangeable circuit comprising a remote control relay, removably attachable to the receiving apparatus and adapted to receive processed signals therefrom. In some embodiments, the receiver base or interchangeable circuit can comprise software code executable by the microcontroller for remotely controlling the target apparatus.

In a variety of embodiments, the target apparatus comprises a lamp, an entertainment system, an appliance, a robotic apparatus, an infrared device, a thermostat, a computer, a security system, a garage door, an electric door lock, a laundry machine, a camera, a video camera, or a mobile device.

BRIEF DESCRIPTION OF THE DRAWINGS

Other systems, methods, features and advantages of the present teachings will be or will become further apparent to one with skill in the art upon examination of the following figures and description.

DESCRIPTION OF VARIOUS EMBODIMENTS

Reference will now be made to various embodiments. While the present teachings will be described in conjunction with various embodiments, it will be understood that they are not intended to limit the present teachings to those embodiments. On the contrary, the present teachings are intended to cover various alternatives, modifications, and equivalents, as will be appreciated by those of skill in the art.

Figure 5:
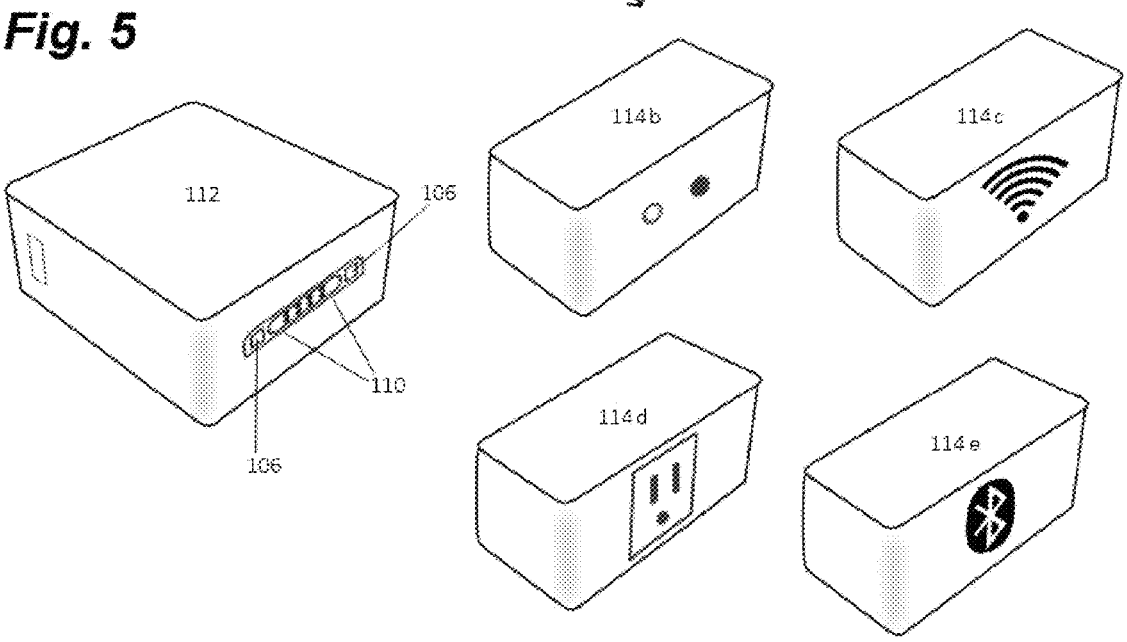
FIG. 5 is a perspective-view of a programmable receiver base illustrating a magnetic circuit connector for attaching various interchangeable accessory circuits, according to various embodiments.

Various aspects of the present invention relate to three components; namely, a wireless gauntlet transmitter (shown generally at 98 in FIG. 1), a programmable receiver base (shown at 112 in FIG. 5), and an interchangeable accessory circuit (various units, each designated generally at 114, shown in FIG. 5). Both the wireless gauntlet 98 and receiver base 112 can initiate encrypted long-range communication with each other, e.g., according to the standards of 2.4 GHz wireless technology.

Figure 1:
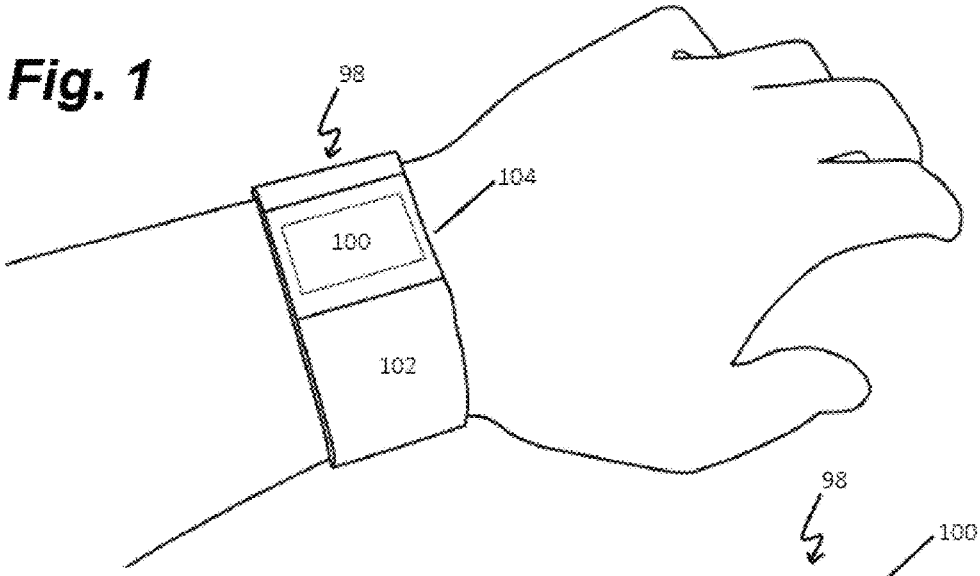
FIG. 1 is a perspective-view of a wireless gauntlet worn on a wrist, according to various embodiments.
Figure 2:
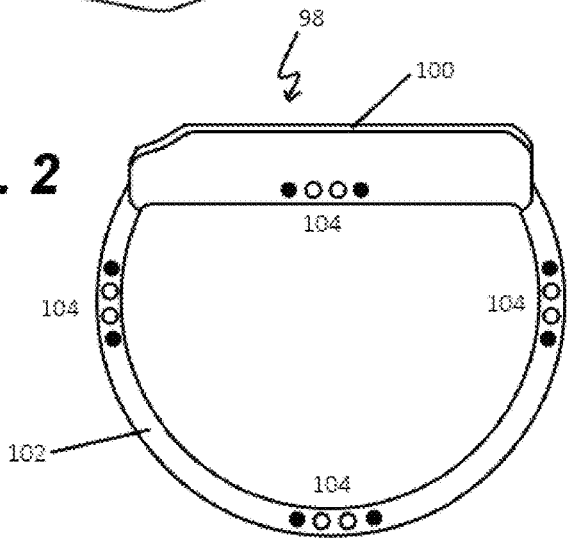
FIG. 2 is a side-view of a wireless gauntlet with IR sensor arrays, according to various embodiments.
Figure 4:
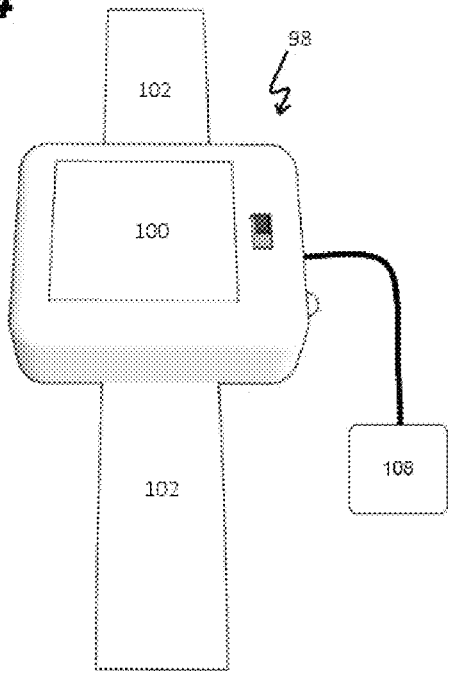
FIG. 4 is a perspective view from above of a wireless gauntlet with a pressure sensor attached, according to various embodiments.

According to various embodiments, and with reference to FIGS. 1, 2 and 4, the wireless gauntlet 98 can comprise a small rectangular apparatus which can be removably attachable to the forearm of a user, for example, through the use of a standard watchband or hook-loop strap 102. In some embodiments, a band for attaching the gauntlet 98 to the arm of a user can comprise or include material that can act as an antenna for wireless transmissions. A casing for the gauntlet 98 can comprise any suitable material. In some embodiments, the casing is comprised of brushed aluminum or stainless steel. The gauntlet 98 can comprise a plurality of electronic sensors, such as an accelerometer, gyroscope, compass, and/or IR sensor array (various components, designated generally at 130, shown in FIG. 6). Additionally, in some embodiments, the gauntlet 98 can be attached to an electrical component comprising a pressure sensor 108 that can sense the force exerted from the user's palm or fingers to obtain additional sensory data (shown in FIG. 4). The pressure sensor 108 can be worn near the gauntlet 98, for example, on the lower palm of the user. In various embodiments, the primary function of the gauntlet 98 is to transmit filtered sensor information to a receiver base 112, which can process the signals. Advantageously, the gauntlet 98 can have an embedded display 100, such as an OLED display, to indicate the time provided by a real-time clock 128 and information received from the receiver base 112. In some embodiments, the gauntlet 98 and the receiver base 112 include mating single-orientation magnetic electrical circuit connectors (not shown) for connecting the gauntlet 98 to the base 112, e.g., in order that a rechargeable battery (not shown) in the gauntlet 98 can be charged.

Figure 3:
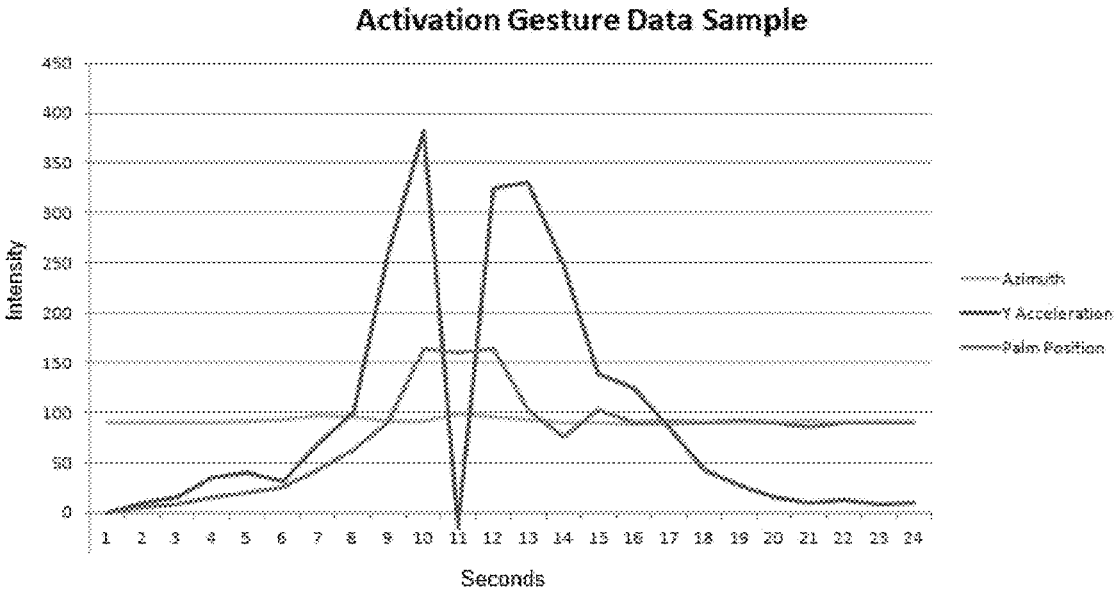
FIG. 3 is a graph of filtered data illustrating the correspondence of voluntary movements detected by the IR sensor arrays, inertial measurement sensors, and compass, according to various embodiments.
Figure 6:
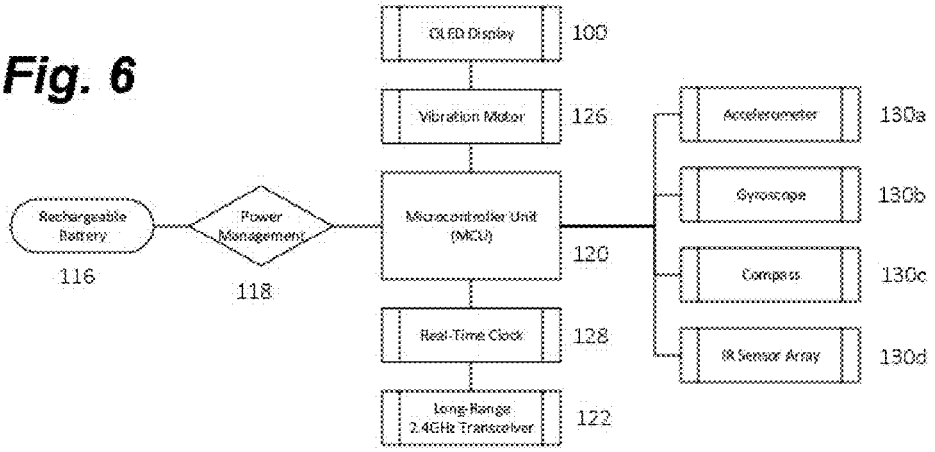
FIG. 6 is a block diagram of system components of a wearable electronic device, according to various embodiments.

As illustrated in FIG. 6, in accordance with various embodiments, the gauntlet's functionality can be provided by way of a microcontroller unit 120 powered by a rechargeable battery 116. Communications between the gauntlet 98 and receiver base 112 can take place with the use of a long-range 2.4 GHz transceiver 122, known to those skilled in the art. As used herein, the term "long-range" means 3,000 feet, or so. An implementation of multiple IR sensor arrays 104, on the wireless gauntlet is illustrated in FIG. 2. Each IR sensor array 104 is arranged with two infrared emitters adjacent to matching infrared photosensors which only detect a specific frequency of infrared light. The average of the reflective value of each IR sensor array 104 is rapidly acquired by the microcontroller 120 to determine the angle in which a user bends his/her wrist. For example, an upward wrist movement would be identified if the microcontroller 120 detects higher values in an upper sensor array 104. To prevent undesired gesture recognition, the microcontroller 120 can be confined to detect only a predefined activation gesture prior to recognizing other gestures. Once a user performs the activation gesture, the gauntlet 98 begins recognizing all other gestures. A predefined gesture is a voluntary action from the user and can only be performed through deliberate movement in a certain sequence. In various embodiments the predefined gesture is an unnatural motion. Exemplary filtered data acquired from the sensors 104 during an activation gesture is shown in FIG. 3. The particular example illustrated suggests that the palm is facing upwards and sharply accelerated backwards toward the user. Those skilled in the art will appreciate that while four sets of IR sensor arrays are depicted in FIG. 2, other IR sensor array configurations can be employed.

Referring to the block diagram of FIG. 6, in various embodiments, a wireless gauntlet may be comprised of components including but not limited to a rechargeable battery 116, power management circuit 118, microcontroller unit 120, OLED display 100, vibration motor 126, real-time clock 128, long-range 2.4 Ghz transceiver 122, accelerometer 130*a*, gyroscope 130*b*, compass 130*c*, and modulated IR sensor array 130*d*. The rechargeable battery 116 is used to supply power to the gauntlet when active. A power management circuit 118 regulates the voltage and current provided to the microcontroller unit 120 and is used to regulate the charging process of the rechargeable battery. A real-time clock 128 is powered directly through the power management circuit 118 to provide accurate time to the microcontroller. A vibration motor 126 is used to indicate successful gestures performed by the user. An OLED display 100 is used to provide the time and information received from the receiver base 112 to the user. The microcontroller 120 is connected to a long-range 2.4 Ghz transceiver 122 to send raw gesture data to the receiver base 112 and receive status messages. An accelerometer 130*a* and gyroscope 130*b* are combined to provide reliable orientation and acceleration data of the movements of the user. A digital compass 130*c* is used to acquire the azimuth of the user relative to the earth's magnetic field. This sensor may be used to detect which direction the user is facing. Furthermore, several modulated IR sensor arrays 130*d* may be embedded on the side of the gauntlet to obtain the user's palm position as aforementioned.

Referring now to FIG. 5, in various embodiments, the programmable receiver base 112 can reside near the application to be controlled. The application can be, for example, an apparatus such as a robot, an electrical appliance, mobile device, or a computer (not shown). An accessory circuit (an interchangeable module of relative size, meaning approximately the same or similar) 114 can be magnetically attached to an end of a receiver base 106 through a multi-pin connector 110. The receiver base 112 can detect and communicate with the aforementioned accessory circuit 114 in electrical relationships, depending on the purpose of the application. The receiver base 112 may have the ability to perform firmware updates to the wireless gauntlet when the gauntlet is attached to the USB interface 132. Likewise, the receiver base 112 may also have the ability to recharge the battery 116 of the wireless gauntlet when both are electrically connected. The firmware of receiver base 112 can be configured and updated through connection with a computer via the USB interface 132. Any configurations performed to the receiver base are used to improve the functionality of the gesture recognition or compatibility with interchangeable accessories 114.

Figure 7:
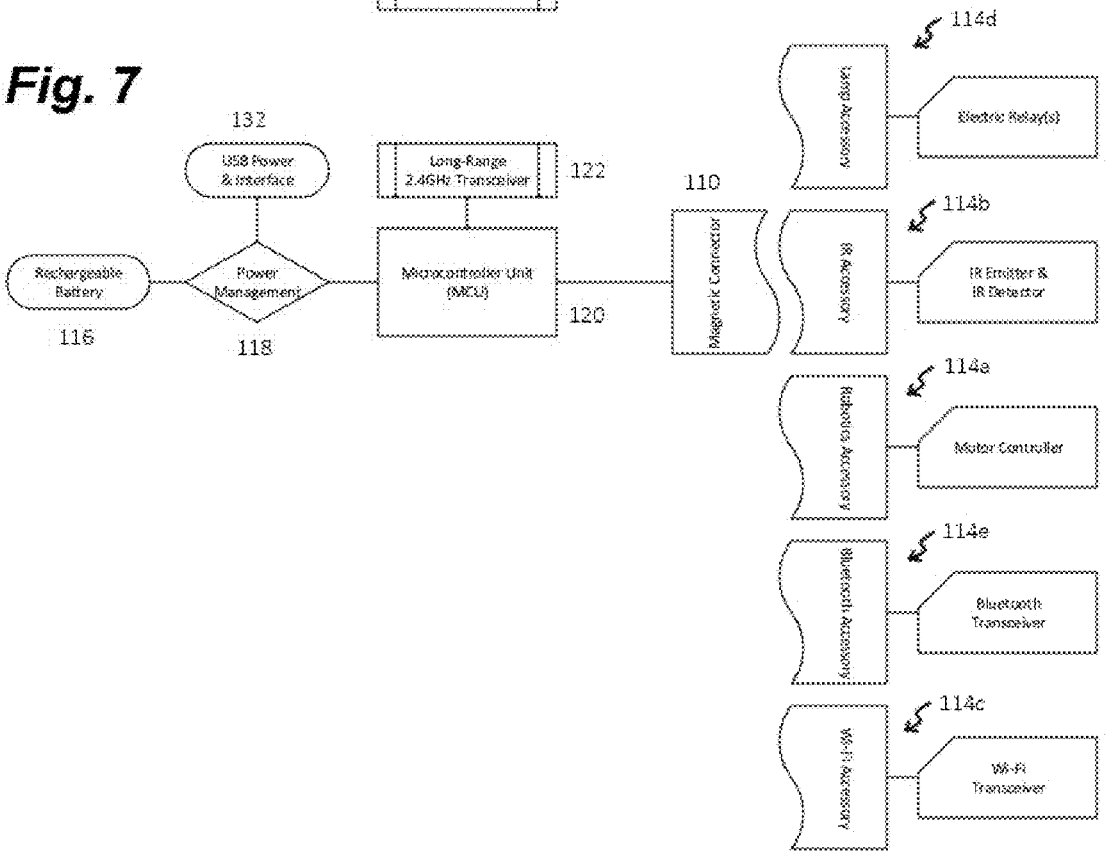
FIG. 7 is a block diagram of system components of a programmable receiver base illustrating the use of interchangeable accessory circuits, according to various embodiments.

According to various embodiments, and referring now to FIG. 7, the receiver base 112 can comprise a rechargeable battery 116, USB power & interface 132, power management circuit 118, microcontroller unit 120, long-range 2.4 Ghz transceiver 122, and multi-pin magnetic connector 110. The rechargeable battery 116 is used to supply power to the gauntlet when active. A power management circuit 118 regulates the voltage and current provided to the microcontroller unit 120 and is used to regulate the charging process of the rechargeable battery. The USB power & interface circuit 132 can be used to recharge the rechargeable battery 116 of both the wireless gauntlet 98 and receiver base 112. Likewise, the USB interface may also be used to update the firmware of the receiver base 112 and the wireless gauntlet 98. The long-range 2.4 Ghz transceiver 122 is used to receive signals from a wireless gauntlet 98. The microcontroller unit 120 in receiver base 112 is used to process gesture data received from the transceiver 122 and perform predefined electrical action(s) in correlation to the interchangeable accessory 114 currently attached. Advantageously, in some embodiments, the receiver 112 can be interfaced with custom-built circuits (not shown) for user testing, prototyping, and educational purposes.

An interchangeable accessory 114 can be of relative size and shape to the programmable receiver base 112. Interchangeable accessories 114 (shown in FIG. 5) attached to the receiver base 112 can allow the wireless gauntlet the ability to control a variety of apparatus, such as a lamp, appliance, robotic, infrared device, thermostat, computer, security system, garage door, door lock, washing machine, etc. Furthermore, an auxiliary circuit 114 can include means to removably bond the accessory circuit to the receiver base 112. For example, strong neodymium magnets 106 can be used to removably bond the accessory circuit 114 to the receiver base 112, as shown in FIG. 5. According to various embodiments, an interchangeable accessory 114 comprises modular circuitry that primarily connects an application to the programmable receiver base 112, so that it can be controlled by the user. In various embodiments, for example, if the user wishes to control their lamp(s) or other appliances, they can attach a lamp accessory 114*d* (shown in FIG. 5), containing electrical relay(s) and other regulatory circuits, to the receiver base. In another embodiment, if the user wishes to control a robotic system such as a robotic arm or a small vehicle, they can simply replace the aforementioned interchangeable accessory with a motor accessory 114*a* that offers motor control capabilities which is respectively designed for the intended robot. In some embodiments, if the user wishes to control a television or any other device that uses infrared communication, they can connect an interchangeable IR accessory 114*b* which can emulate infrared signals with an IR emitter and detector. Optionally, the IR sensor arrays 104 on the wireless gauntlet 98 may be used to emulate infrared signals as well. In another embodiment, if the user wishes to control features on a smartphone or other mobile device, they can attach a Bluetooth accessory 114*e* or Wi-Fi accessory 114*c* to the receiver base 112 to achieve the respective wireless functionality. Additionally, the Wi-Fi accessory may be used to connect communications from the wireless gauntlet 98 to a predefined internet server to achieve IoT capability. This embodiment would allow the gauntlet 98 to control other IoT devices with predefined gestures. Notably, in various embodiments, a user does not have to connect any accessory to control applications on a computer except to connect the receiver base 112 to the desired computer to be controlled.

Referring back to FIG. 1, a user can interact with a receiver base 112 by navigating through a list on the built-in display 100 on the wireless gauntlet 98 and controlling the selected device with wrist gestures. In the initial configuration of connecting a wireless gauntlet 98 to a receiver base 112, the user wirelessly pairs both devices together. This can be achieved by pushing a button on both devices (not shown) to perform a wireless handshake. Once both devices are wirelessly paired, the wireless connection is automatically established anytime both devices are turned on. This connection information may be stored on the memory of both the gauntlet 98 and receiver base 112. The wireless connection to a specific receiver base 112 can be shared to another user with a different gauntlet 98, by the user with the gauntlet 98 who initially connected with the specific receiver base.

In various embodiments, depending on the application of a connected accessory 114, a receiver base 112 may support two modes of interaction in the event two or more gauntlet devices are wirelessly paired with the receiver. These modes are preconfigured in the microcontroller 120 and may be changed by the user at any time. The first mode is an alternating mode that allows only one wireless gauntlet 98 to possess control over the receiver base at a time. Other gauntlets connected to the receiver base are not able to control the receiver base unless the gauntlet 98 in possession of control transfers the privilege to another wireless gauntlet 98. The alternating mode is beneficial in an embodiment which involves multiple users controlling a sensitive device such as a robot; only one user may control the robot at a time. A user may transfer their privilege of control to another gauntlet 98 by making a predefined gesture. The second mode is a simultaneous mode that allows two or more gauntlets 98 to connect and control the base 112 simultaneously. The simultaneous mode is beneficial in an embodiment which involves multiple users attempting to control devices such as appliances. For example, family members each wearing a gauntlet 98 may control a receiver base with an accessory connected to a lamp. The lamp may be triggered on a first-to-control basis.

Figure 8:
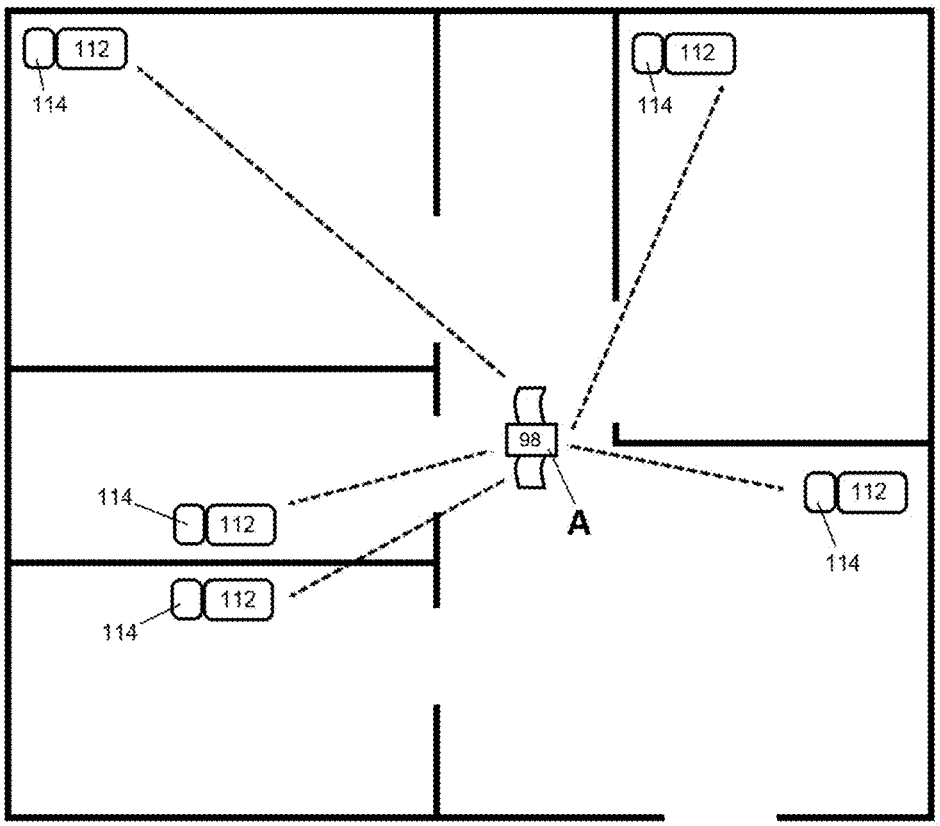
FIG. 8 illustrates a wireless gauntlet in a control-zone, according to various embodiments.
Figure 9:
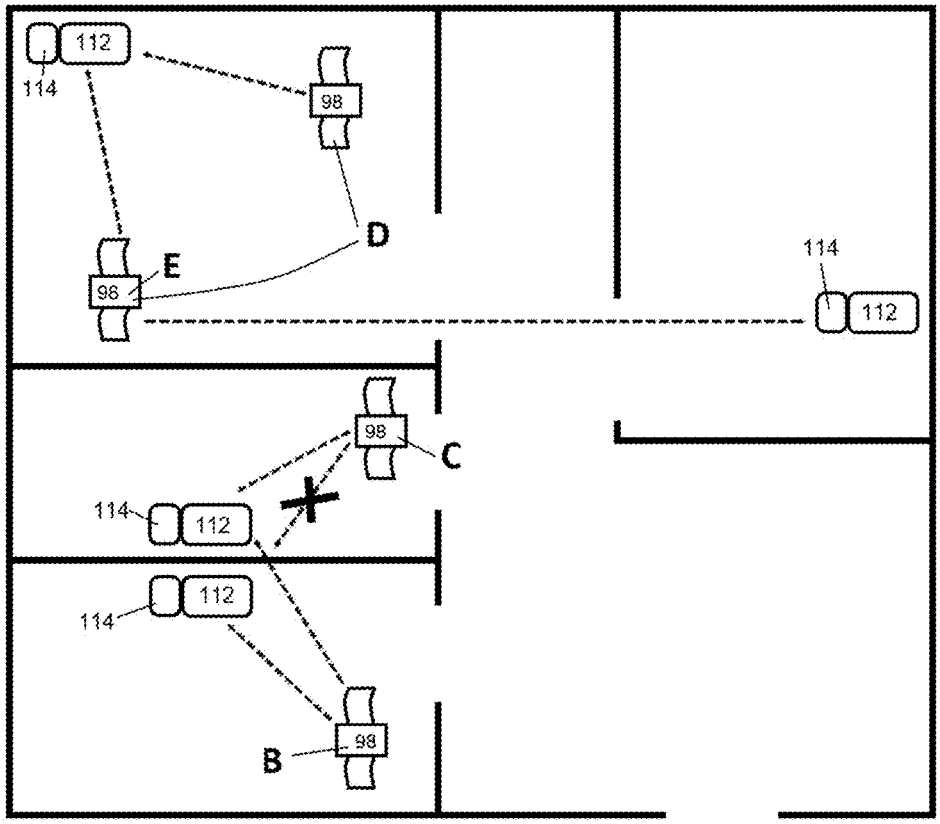
FIG. 9 illustrates a wireless gauntlet in a control-zone, according to various embodiments.

With the long-distance wireless abilities of various embodiments of the present invention, the wireless gauntlet can be used in an environment with many receiver bases and effectively communicate to specific receiver bases, for example, by using control-zones, as shown in FIGS. 8-9. In FIGS. 8-9, the reference numerals shown indicate elements previously described herein. In various embodiments, a control-zone comprises a set of receiver bases installed in a particular area or room of a building. In various embodiments, a user wearing a wireless gauntlet can enter a building with a control-zone (shown at "A" in FIG. 8) and acquire the ability to wirelessly control all electrical apparatus, such as appliances, robotics, and computers, in that area. In some embodiments, if the same user approaches a nearby room with a control-zone, he or she can choose to switch between control-zones (shown at "B" in FIG. 9) to the respective room and control the respective devices in that room. Control-zones can be accessible to the user as he/she approaches a wireless proximity with a receiver base. Receiver bases can be manually or automatically added to a control-zone through the programming of the receiver base 112. In a variety of embodiments, control-zones can be used to administer access to buildings in which areas need to be secured (shown at "C" in FIG. 9). In some embodiments, the wireless gauntlet can be configured with a specific identification algorithm to identify itself to nearby control-zones. Creating secured control-zones can allow certain users to be assigned access to specific control-zone(s). This can be beneficial to prevent unauthorized access to office appliances, doorways, and other applications by defining an array of controllable applications. In a control-zone, a user can interact with an array of devices through the orientation of their forearm and palm. In various embodiments, multiple users wearing a wireless gauntlet can interact together to control a specific receiver base (shown at "D" in FIG. 9). As aforementioned, the alternating and simultaneous modes are used to govern the wireless controls in such situations. This can be useful in situations that require collaborative design, control, or composition. In addition, according to various embodiments, buttons and other tactile sensors can be used to facilitate communication from the user to the device. The orientation and status of the gauntlet can be displayed on the built-in display. Furthermore, in some embodiments, a receiver base can be configured to allow all gauntlets wireless access control of the attached auxiliary circuit, regardless of access privileges preconfigured in the gauntlets or whether it is inside a control-zone. For example, an employee with a wireless gauntlet can acquire full wireless control of the lights, presentation, computer, and environment in a meeting room by simply entering the premises (shown at "E" in FIG. 9).

All references set forth herein are expressly incorporated by reference in their entireties for all purposes.

Those skilled in the art can now appreciate from the foregoing description that the broad teachings herein can be implemented in a variety of forms. Therefore, while the present teachings have been described in connection with various embodiments and examples, the scope of the present teachings are not intended, and should not be construed to be, limited thereby. Various changes and modifications can be made without departing from the scope of the present teachings.

What is claimed is:

1. A wireless control system comprising:

a wearable device adapted to be worn on the forearm of a user and comprising a wireless transmitter for wirelessly transmitting signals comprising sensory data;

an electrical component that includes a pressure sensor that can sense force exerted by a palm or one or more fingers of the user;

a receiver base comprising a wireless receiver and a processor, for receiving wirelessly transmitted signals comprising sensory data and processing said signals, wherein the receiver base includes a magnetic connector adapted to interface with interchangeable accessories, the interchangeable accessories when attached to the magnetic connector being in electrical communication with the receiver base, the interchangeable accessories being adapted to conduct electrical interaction with a target apparatus.

2. The system of claim 1, wherein said target apparatus comprises a lamp, an entertainment system, an appliance, a robotic apparatus, an infrared device, a thermostat, a computer, a security system, a door, an electric door lock, a laundry machine, a camera, a video camera, or a mobile device.

3. The system as recited in claim 1, wherein the magnetic connector includes a magnetic electrical circuit connector and a mating magnetic electrical circuit connector on each of the interchangeable accessories.

4. The system as recited in claim 1, wherein the receiver base controls the interchangeable circuit using sensory data received from the wireless gauntlet.

5. The system as recited in claim 1, wherein the interchangeable circuit comprises electrical circuitry configured with electrical correspondence to the receiving apparatus.

6. The system as recited in claim 1, further comprising strong magnetic elements of opposing polarity positioned on the interchangeable circuit and the receiving apparatus for removably attaching the interchangeable circuit to the receiving apparatus.

7. The system as recited in claim 1, wherein the interchangeable circuit is of relative size and shape to the receiving apparatus.

8. The system as recited in claim 1, further comprising a rechargeable battery providing power for the receiving apparatus, and a second rechargeable battery providing power for the wireless gauntlet.

9. The system as recited in claim 1, wherein the receiving apparatus comprises programmable circuitry for configuring identification of the receiving apparatus and the target apparatus.

10. A wireless control system as recited in claim 1, additionally comprising:

a band that includes material that acts as an antenna for wireless transmission.

11. A wireless device for the control of a target electrical apparatus, such as a robotic instrument, an electrical appliance, a mobile device or a computer, comprising:

a wireless gauntlet comprising a casing;

a band attached to the casing in order that the gauntlet can be worn on the forearm of a user;

one or more inertial measurement sensors within said casing;

one or more modulated infrared sensor arrays supported by said casing and said band; and a processor within said casing and disposed for receiving inputs from said inertial measurement sensors and said modulated sensor arrays; wherein said processor is programmed to calculate the orientation of a user's palm and fingers using inputs from said inertial measurement sensors and said modulated sensor arrays, with the user's palm and fingers being free of any orientation measurement apparatus; and a long-range wireless transceiver for transmitting signals from said processor.

12. The device as recited in claim 11, further comprising software code executable by the microprocessor of the wireless gauntlet for calculating the palm position in which a wrist is bent based on at least two of the modulated infrared sensor arrays.

13. The device as recited in claim 11, further comprising a force sensor in communication with said microcontroller of said gauntlet and a second band attached to the gauntlet for supporting said force sensor, wherein said second band is removably attachable to a user's hand.

14. The device as recited in claim 11, wherein the wireless gauntlet comprises an accelerometer, a gyroscope, and a compass, each disposed for communication with said processor.

15. A system for remote control of electrical apparatus, said system including a wireless gauntlet adapted to be worn on a user's wrist and configured to transmit wireless signals comprising sensory data containing information about the user's wrist orientation, acceleration, and direction; wherein said system comprises:

a base station;

a wireless receiver in said base station for receiving said wireless signals;

a processor within said base station for processing signals received;

wherein the user's forearm gesture can be determined with the information received on wrist orientation, acceleration, and direction; and further wherein the position of the user's palm relative to the user's wrist can be calculated; and further comprising an electrical interface for electrical communication with an interchangeable accessory circuit to interact with a robotic instrument, an electrical appliance, mobile device or a computer in a manner determined by the user's gesture and palm position.

16. The system as recited in claim 15, further comprising a control-zone comprised of a designated plurality of base stations disposed in a defined area, all within the transmission range of a long-range wireless gauntlet.

17. The system as recited in claim 16, wherein each base station of said designated plurality of base stations comprises programmable circuitry for associating every base station with the other base stations of the control zone.

18. A system as recited in claim 16, wherein said designated plurality of base stations in the control-zone are configured to be controllable by one or more selected wireless gauntlets.

19. A system as recited in claim 16, wherein a predefined gesture by the user causes a wireless gauntlet worn by the user to transmit signals for switching its interaction from the base station to a second base station in the control-zone or switching from the control zone to a second control zone.

20. A system as recited in claim 16, wherein the base station can communicate with a plurality of wireless gauntlets in the control zone.

21. A system as recited in claim 16, wherein a plurality of wireless gauntlets can simultaneously control a selected base station within the control zone.

22. A system as recited in claim 16, wherein a base station in the control zone is configured to extend the wireless range of another base station in the control zone.

* * * * *